United States Patent [19]

Simon

[11] Patent Number: 4,563,194

[45] Date of Patent: Jan. 7, 1986

[54] WATERWALL FOR A TWIN TOWER GASIFICATION SYSTEM

[75] Inventor: James J. Simon, Windsor, Conn.

[73] Assignee: Cool Water Coal Gasification Program, Daggett, Calif.

[21] Appl. No.: 598,845

[22] Filed: Apr. 10, 1984

[51] Int. Cl.[4] ..... C10J 3/48; C10J 3/76; C10J 3/86

[52] U.S. Cl. ..... 48/77; 48/67; 48/69; 122/6 A; 122/7 R; 122/235 A; 122/235 K; 122/235 N; 165/169

[58] Field of Search ..... 48/67, 77, 69; 165/169; 122/6 A, 7 R, 235 A, 235 K, 235 N, 367 R

[56] References Cited

U.S. PATENT DOCUMENTS 4,270,493 6/1981 Blaskowski ..... 48/77

4,328,007 5/1982 Rafael ..... 48/77

4,343,626 8/1982 Peise et al. ..... 48/67

4,488,513 12/1984 Jahnke et al. ..... 122/7 R 4,493,291 1/1985 Zabelka ..... 122/6 A

*Primary Examiner*—Peter Kratz

*Attorney, Agent, or Firm*—Lyon & Lyon

[57] ABSTRACT

A waterwall for a twin tower gasification system wherein the two towers are fluidically connected intermediate their ends. The waterwall comprises a plurality of tubes, a portion of which extend from the first tower to the second tower and define a cylinder. The portion of the tubes extending between the towers are twisted into a helix such that the portion of the tubes that define the lower portion of the cylinder at the first tower, define the upper portion of the cylinder at the second tower.

10 Claims, 5 Drawing Figures

WATERWALL FOR A TWIN TOWER GASIFICATION SYSTEM

BACKGROUND OF THE INVENTION

The present invention is in the field of waterwalls for twin tower gasification systems. More specifically, the invention is directed to a tubular waterwall, capable of carrying a coolant, for twin tower coal gasification systems.

Twin tower systems for coal gasification employ a radiant boiler tower and a convection boiler tower. These boilers are generally connected by a transfer duct. In the actual process of gasification, oxygen and a coal slurry are injected into a gasification zone above the radiant boiler tower wherein the coal slurry is ignited forming hot gas and molten slag. The hot gases flow downward and excess slag and soot fall to the bottom of the tower. The gas flows through the transfer or connecting duct to the convection boiler where the gas flows upward to the top of the convection boiler.

The temperature of the raw coal gas is sufficiently high to cause destructive thermal stresses on the internal surfaces of the towers and the connecting duct. Also the raw coal gas is corrosive. As such, tubular waterwalls carrying coolant are utilized to protect the walls of the boilers, to lower the temperature of the raw gas and to recover the transferred heat as saturated steam. Because of the harsh environment tubular waterwalls are subject to frequent failure. The failures generally occur at fittings and headers. Heretofore, an inordinate number of fittings and headers have been required in forming the liner. Thus, the number of points where failure is more likely is increased. When a fitting fails costly and time consuming replacement procedures are required. Also initial construction of these systems are complex resulting in high construction costs.

SUMMARY OF THE INVENTION

The present invention pertains to a waterwall for a two tower gasification system, wherein the two towers are connected intermediate their ends as by a connecting duct. The waterwall is of the type having a series of tubes diametrically joined together to form a continuous inner surface. The waterwall is designed for a reduction in the number of internal fittings and headers, protection of all internal surfaces, and ease of construction.

To eliminate fittings in the tubular waterwall at the connecting duct and tower junctions, a number of tubes lining a portion of each tower may be utilized to form a waterwall for the connecting duct. This can be accomplished by forming bends in a portion of the tubes that extend upwardly from the bottom of each tower such that the tubes pass through the connecting duct to the other tower. The tubes passing through the duct are formed into a helix such that the tubes enter the connecting duct along the bottom and exit the other end of the connecting duct along the top. Bends are again formed in the portion of tubes passing through the connecting duct as they exit the connecting duct, such that the tubes may extend along the tower walls toward the top of each tower.

Thus, fabrication is simplified, the waterwall is self supporting throughout the connecting duct and internal fittings and headers may be eliminated at the tower/-connecting duct junction. As such, this design avoids the problems associated with fittings and headers; namely, frequent failures and the resulting costly and time consuming replacement associated with such failures.

Accordingly, it is an object of the present invention to provide a continuous waterwall for a two tower gasification system without utilizing an inordinate number of internal fittings or headers, and yet protecting the inner surfaces of the system and having ease of construction. Other and further objects and advantages will appear hereinafter.

DETAILED DESCRIPTION OF THE PREFERRED EMBODIMENT

Figure 1:
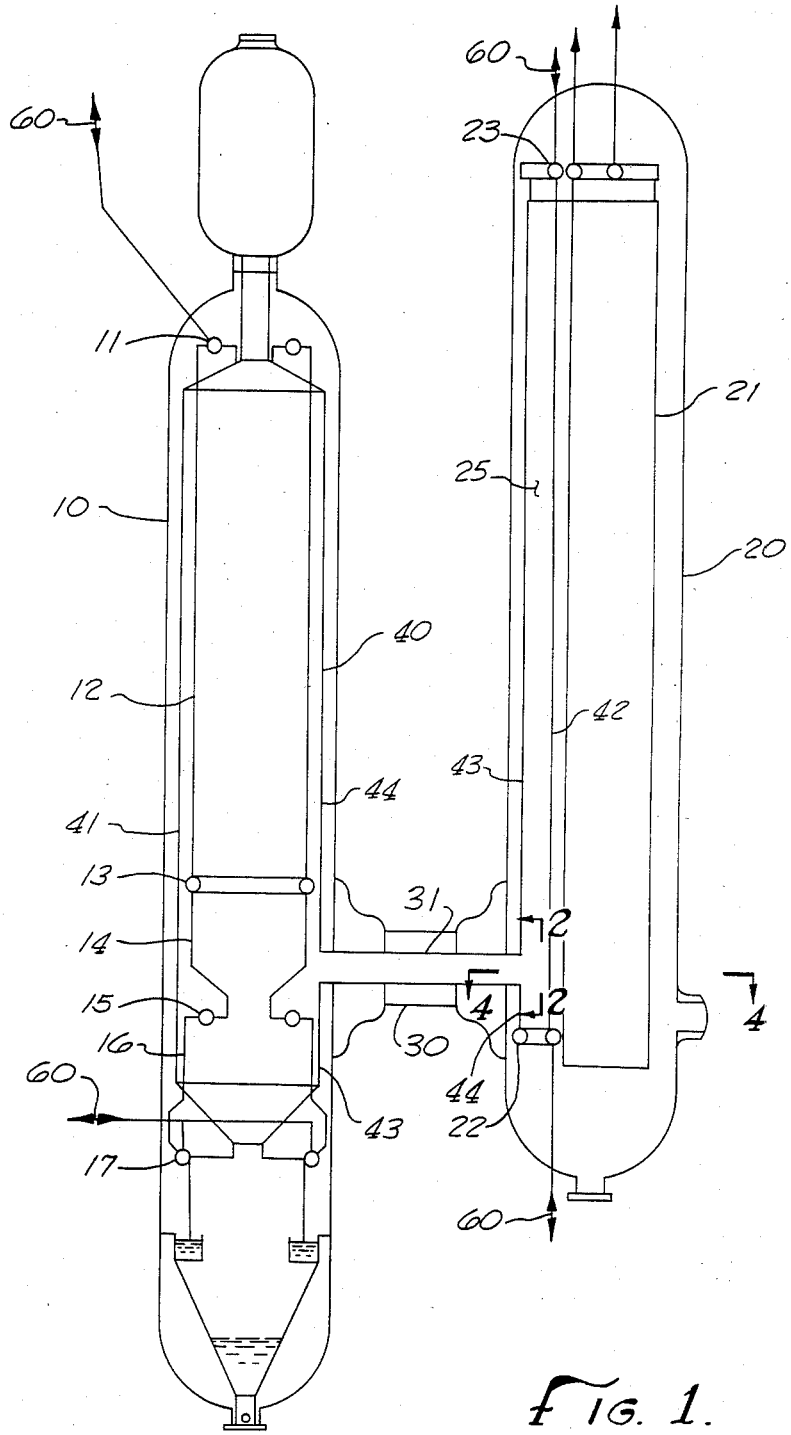
FIG. 1 is schematic view of a waterwall of the present invention embodied in a two tower gasification system.
Figure 2:
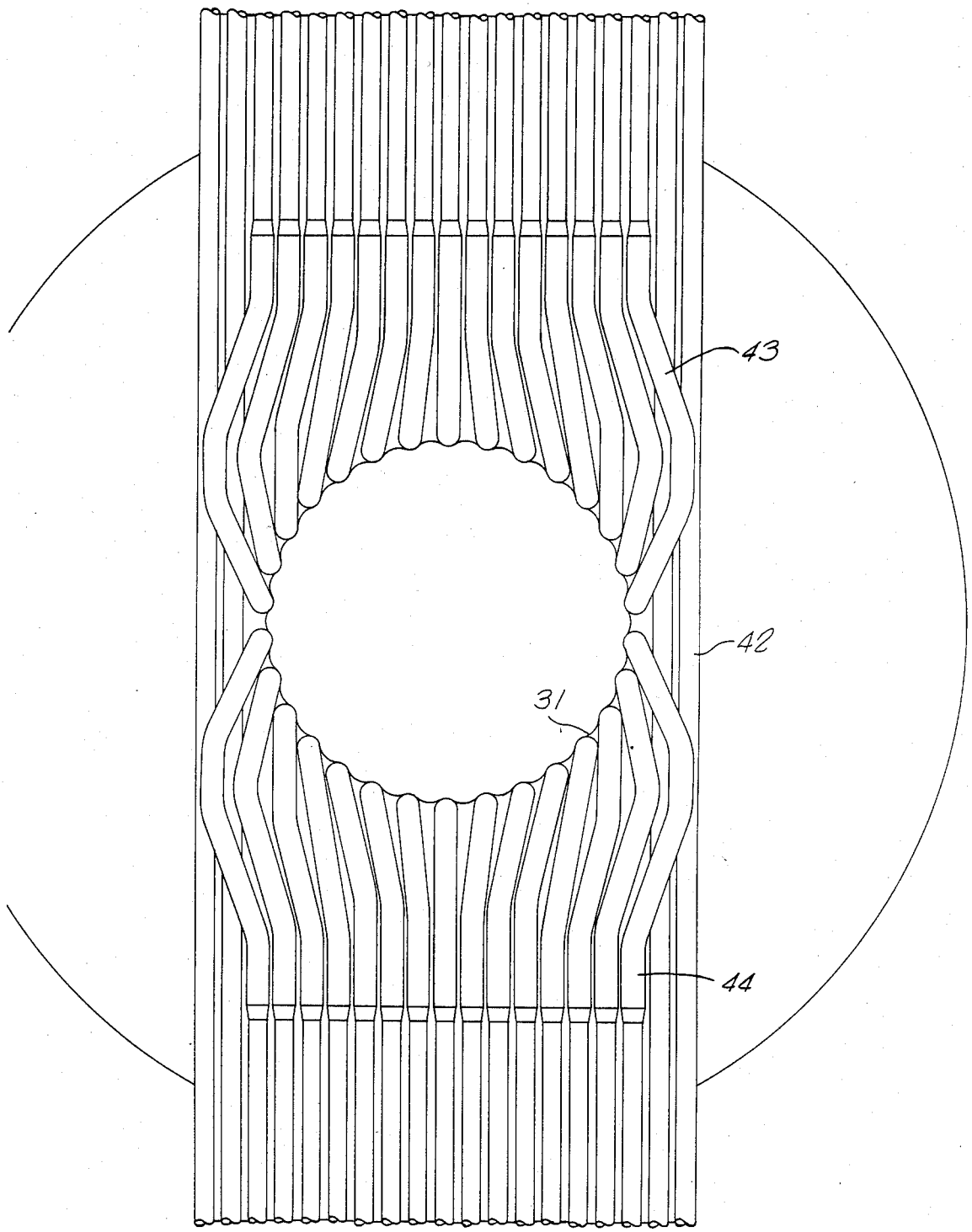
FIG. 2 is an enlarged sectional view taken along the plane 2—2 of FIG. 1.

With reference to FIGS. 1 through 5, a waterwall is disclosed embodied in a two tower gasification system. In the two tower system a first tower 10 is connected to a second tower 20 by means of a connecting duct 30. Generally, the first tower 10 is referred to as a radiant boiler or a radiant vessel and the second tower 20 is referred to as a convection boiler or a convection vessel. The waterwall is basically comprised of three sections: a liner 40 in the radiant boiler 10, a cylinder 31 lining the connecting duct 30, and an upflow duct 25 in the convection boiler 20.

During operation oxygen and a coal slurry are injected into a gasification zone above the radiant boiler 10, wherein the coal slurry is ignited forming hot gas and molten slag. The hot gases emitted when the coal slurry is ignited flow downward inside the liner 40. In addition to the liner 40 there are usually additional tubes forming a restriction at the lower portion of the radiant boiler 10. In FIG. 1, a series of approximately eight tubes 12 extend from a first manifold 11 to a centrally located middle manifold 13. Another series of tubes are formed into a conical section 14 between the middle manifold 13 and an intermediate manifold 15. Another series of approximately eight tubes 16 extend from the intermediate manifold 15 to a second manifold 17. As the gases flow downward, so also does the soot and slag associated with the burning of the coal. The soot and slag fall to the bottom of the tower where they are generally collected in a water bath which is changed as needed. The gas upon reaching the bottom of the radiant boiler 10 is then directed upward and through the connecting duct 30 to the convection boiler 20.

In the convection boiler 20 the gas flows upwardly in the upflow duct 25 to the top of the convection boiler 20. After exiting the upflow duct 25 at the top of the convection boiler 20, the gas is redirected to flow downward through a series of economizers 21. As the gas exits the system at the bottom of the economizers 21 it has reached a temperature whereby that gas may be utilized to drive turbines or other generating equipment. Thus, the waterwall extends the length of the radiant boiler 10 as a liner 40, passes through the connecting duct 30 as the cylinder 31 and extends the length of the convection boiler 20 as an upflow duct 25.

Figure 5:
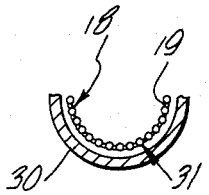
FIG. 5 is an enlarged sectional view taken along the plane 5—5 of FIG. 4.
Figure 4:
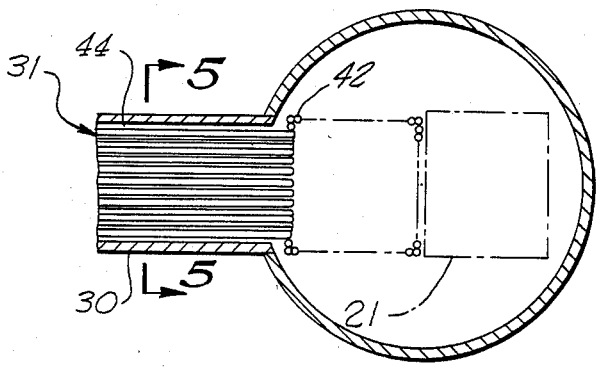
FIG. 4 is an enlarged sectional view taken along the plane 4—4 of FIG. 1.

As is shown in FIG. 5, the waterwall is of a tubular construction. Individual tubes are aligned such that their central axes are parallel and then diametrically joined together to form a continuous inner surface 18. The diametric joining together may be accomplished through the use of web members 19. These web members 19 will vary in shape and size as necessary to ensure that the walls of the radiant boiler 10, the connecting duct 30 and the convection boiler 20 are completely protected.

The waterwall is comprised of four sets of tubes. A first set of tubes 41 extends the length of the radiant boiler 10. This first set of tubes 41 is fluidically attached to the second manifold 17 at the bottom of the radiant vessel 10. The fluidic attachment is such that water or any other fluid or gas may flow from the second manifold 17 into the first set of tubes 41. The first set of tubes 41 extends along the inner surface of the radiant boiler to the first manifold 11 at the top of the radiant boiler 10. The first set of tubes 41 forms a portion of the liner 40, completely lining the inner wall of the radiant vessel 10, except for the portion of the inner wall directly above and directly below the point where the connecting duct 30 meets the radiant boiler 10.

A second set of tubes 42 extends the length of the convection boiler 20. This second set of tubes 42 is arranged in much the same manner as the first set of tubes 41. One end of the second set of tubes 42 is fluidically attached to a third manifold 22 at the bottom of the convection boiler 20 and the other end is fluidically attached to a fourth manifold 23 at the top of the convection boiler 20. The second set of tubes 42 form part of the upflow duct 25 in the convection boiler 20 depicted in FIG. 1. The central axes of the tubes in the second set of tubes 42 are parallel to each other and the tubes are diametrically joined together to form a continuous surface in a manner as previously described.

A third set of tubes 43 is fluidically attached to the second manifold 17 at the bottom of the radiant boiler 10. These tubes extend upwardly from the bottom of the radiant boiler 10. The third set of tubes 43 is connected to the first set of tubes 41 forming the lower half of the liner 40. The individual tubes in the third set of tubes 43 are formed into 90° bends at the junction of the radiant boiler 10 and the connecting duct 30. As the third set of tubes 43 enters the connecting duct 30, it defines the lower half of the cylinder 31. The bends in the third set of tubes 43 at the junction of the radiant boiler 10 and the connecting duct 30 are such that the half-cylinder forms a continuous liner spaced a distance away from the inner surface of the wall of the connecting duct 30.

Figure 3:
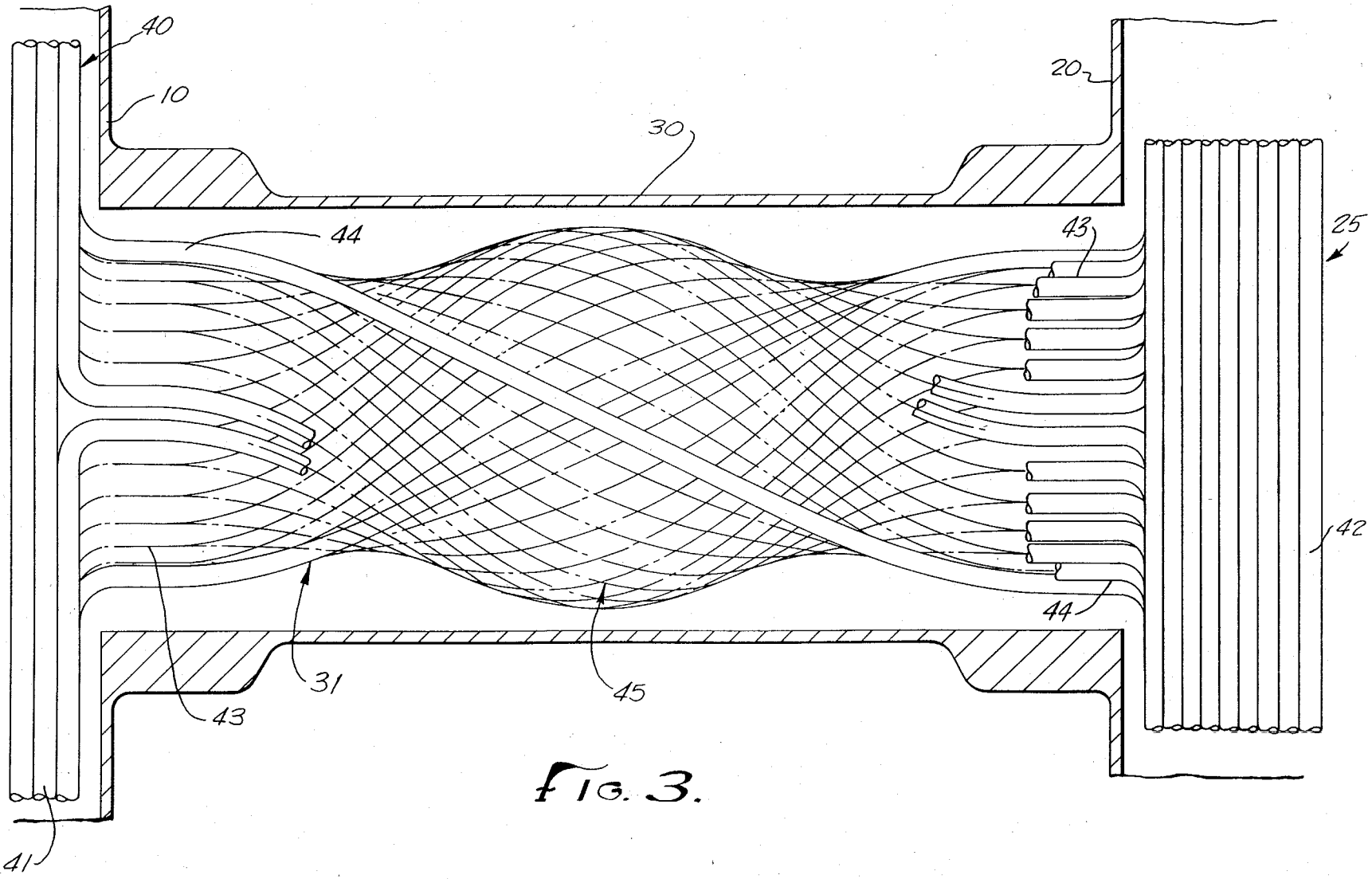
FIG. 3 is an enlarged plan view of the helix in a connecting duct.

As shown in FIG. 3, the third set of tubes 43 is bent such that it forms one-half of a helix 45 as it passes through the connecting duct 30. The helix 45 is shown turning through 180°. The helix 45 must always be formed such that the third set of tubes 43 enters the connecting duct 30 along the bottom and leaves the connecting duct 30 along the top. As the third set of tubes 43 exits the connecting duct 30 the individual tubes are again formed into 90° bends such that the third set of tubes 43 extends upwardly along the inner wall of the convection boiler 20 to the top of the convection boiler 20. In doing so the third set of tubes forms part of the upper portion of the upflow duct 25. The other part being formed by the second set of tubes 42. The third set of tubes 43 and the second set of tubes 42 are joined together, as previously described, to form a continuous inner surface. Although the upflow duct 25 is shown rectangular in cross-section, any cross-sectional shape may be utilized. The third set of tubes 43 is fluidically attached at the top of the convection boiler 20 to the fourth manifold 23.

A fourth set of tubes 44 is formed in much the same manner as the third set of tubes 43. The fourth set of tubes 44 is fluidically attached to the third manifold 22 and extends upwardly from the bottom of the convection boiler 20. The fourth set of tubes 44 is joined with the second set of tubes 42 to form the lower portion of the upflow duct 25. The fourth set of tubes 44 and the second set of tubes 42 are joined together as previously described forming a continuous surface. The individual tubes in the fourth set of tubes 44 are formed into 90° bends at the junction of the convection boiler 20 and the connecting duct 30. As the fourth set of tubes 44 enters the connecting duct 30, it defines the lower half of the cylinder 31. The bends in the fourth set of tubes 44 at the junction of the convection boiler 20 and the connecting duct 30 are such that the cylinder 31 forms a continuous liner spaced a distance away from the inner surface of the wall of the connecting duct 30. The third set of tubes 43 and the fourth set of tubes 44 are diametrically joined together in the connecting duct 30 forming the cylinder 31.

As shown in FIG. 3, the fourth set of tubes 44 is bent to form one-half of the helix 45 as it passes through the connecting duct 30. As with the third set of tubes 43, the helix 45 must always be formed such that the fourth set of tubes 44 enters the connecting duct 30 along the bottom and leaves the connecting duct 30 along the top. An advantage other than maintaining a constantly upward flow of the coolant achieved by forming the tubes into a helix is that the cylinder 31 is self-supporting. In some applications it might be desirable not to have the individual tubes joined together throughout the helix 45.

As the fourth set of tubes 44 exits the connecting duct 30, the individual tubes are again formed into 90° bends such that the fourth set of tubes 44 extends upwardly along the inner wall of the radiant boiler 10 to the top of the radiant boiler 10. The first set of tubes 41 and the fourth set of tubes 44 are diametrically joined together to form the upper portion of the liner 40. The fourth set of tubes 44 is fluidically attached to the first manifold 11.

The first manifold 11, the second manifold 17, the third manifold 22 and the fourth manifold 23 all have ports 60 such that water or any other fluid or gas may flow freely into or out of the manifolds and are annular in shape.

Thus, a waterwall for a twin tower coal gasification system capable of having a minimum number of intermediate fittings and manifolds is disclosed. While embodiments and applications of this invention have been shown and described, it would be apparent to those skilled in the art that many more modifications are possible without departing from the inventive concepts herein. The invention, therefore, is not be be restricted except in the spirit of the appended claims.

What is claimed is:

1. Apparatus comprising a first tower and a second tower fluidically connected intermediate their ends, comprising tubes which are diametrically joined together to form a continuous inner surface; wherein a portion of said tubes which extend along the walls of the first tower extend through a connecting duct to the second tower and a portion of said tubes which extend along the walls of the second tower extend through said connecting duct to the first tower such that said portions of said tubes that extend through said connecting duct define a cylinder and are formed into a helix such that said portion of said tubes which extend along the walls of the first tower and which defines the lower half of said cylinder at the first tower, defines the upper half of said cylinder at the second tower.

2. Apparatus for a two tower gasification system comprising a first tower and a second tower fluidically connected intermediate their ends including tubes, said tubes comprised of four sets of tubes;

a first set of tubes extending along the walls of the first tower;

a second set of tubes extending along the walls of the second tower;

a third set of tubes extending upwardly from the bottom of the first tower, extending transversely to the second tower through a connecting duct, extending upwardly along the walls of the second tower;

a fourth set of tubes extending upwardly from the bottom of the second tower, extending transversely to the first tower through a connecting duct, wherein said fourth set of tubes and said third set of tubes define a cylinder connecting the two towers and said fourth set of tubes upon exiting the connecting duct extends upwardly to along the walls of the first tower; wherein said third set of tubes and said fourth set of tubes are formed into a helix such that said third set of tubes defines the lower half of said cylinder at the first tower and defines the upper half of said cylinder at the second tower.

3. Apparatus of claim 2 wherein said tubes are diametrically joined together forming a continuous surface.

4. Apparatus of claim 2 wherein only said tubes lining the first tower, the second tower and connecting duct up to the beginning of said helix are diametrically joined together forming a continuous surface.

5. Apparatus of claim 2 wherein said tubes are diametrically joined together by web members, forming a continuous surface.

6. Apparatus of claim 2 wherein said third set of tubes is formed into a 180° helix.

7. Apparatus for a two tower coal gasification process comprising a first tower including a radiation boiler and a second tower including a convection boiler fluidically connected intermediate their ends by a connecting duct;

comprising a liner section in the radiation boiler, a cylinder in the connecting duct and an upflow duct in the convection boiler; wherein said liner section, said cylinder and said upflow duct are comprised of a plurality of tubes diametrically joined together by web members to form a continuous surface and said plurality of tubes carry a heat exchange medium and comprise four set of tubes;

a first set of tubes extending the length of the radiant boiler;

a second set of tubes extending the length of the convection boiler;

a third set of tubes extendng upwardly from the bottom of the radiant boiler, extending transversely through the connecting duct, extending upwardly to the top of the convection boiler wherein said first set of tubes and said third set of tubes are joined together to form the lower portion of said liner section and said third set of tubes and said second set of tubes are joined together to form the upper portion of said upflow duct;

a fourth set of tubes extending upwardly from the bottom of the convection boiler, extending transversely through the connecting duct extending upwardly to the top of the radiant boiler; wherein said third set of tubes and said fourth set of tubes form said cylinder and are twisted into a 180° helix as they pass through the connecting duct such that said third set of tubes defines the lower half of said cylinder at the radiant boiler, and defines the upper half of said cylinder at the convection boiler; said first set of tubes and said fourth set of tubes are joined together to form the upper portion of said liner section, and said second set of tubes and said fourth set of tubes are joined together to form the lower portion of said upflow duct.

8. Apparatus of claim 7 wherein said first set of tubes and said fourth set of tubes attach to a first manifold;

said first set of tubes and said third set of tubes attach to a second manifold;

said second set of tubes and said fourth set of tubes attach to a third manifold; and said second set of tubes and said third set of tubes attach to a fourth manifold.

9. Apparatus of claim 8 wherein said first, second, third and fourth manifolds are annular in shape.

10. Apparatus of claim 9 wherein said first, second, third and fourth manifolds comprise ports.

* * * * *